US005600082A

United States Patent [19]

Torimura

[11] Patent Number: 5,600,082

[45] Date of Patent: Feb. 4, 1997

[54] ELECTRONIC MUSICAL INSTRUMENT WITH MINUS-ONE PERFORMANCE RESPONSIVE TO KEYBOARD PLAY

[75] Inventor: Hiroyuki Torimura, Hamamatsu, Japan

[73] Assignee: Yamaha Corporation, Japan

[21] Appl. No.: 492,751

[22] Filed: Jun. 21, 1995

[30] Foreign Application Priority Data

Jun. 24, 1994 [JP] Japan ..... 6-164942

[51] Int. Cl.[6] ..... G10H 1/36

[52] U.S. Cl. ..... 84/610; 84/634

[58] Field of Search ..... 84/609–614, 634–638

[56] References Cited

U.S. PATENT DOCUMENTS 5,367,121 11/1994 Yanase ..... 84/666

FOREIGN PATENT DOCUMENTS 5-173561 7/1993 Japan .

*Primary Examiner*—Stanley J. Witkowski
*Attorney, Agent, or Firm*—Graham & James LLP

[57] ABSTRACT

An electronic musical apparatus is constructed to play an automatic performance and a manual performance during progression of a musical composition. A data memory is provided for storing a sequence of automatic performance data representative of the musical composition which is composed of a plurality of parts and which is divided into a series of passages by musically rational manner, and for storing a sequence of check point data indicative of break points of the passages. An input implement is manually operated for inputting a sequence of manual performance data assigned to a particular part of the musical composition. A tone generator receives the inputted manual performance data for sounding the manual performance. A microprocessor sequentially retrieves the automatic performance data and the check point data from the data memory and for feeding the retrieved automatic performance data to the tone generator so as to enable the same to sound the automatic performance. The microprocessor further operates when the manual performance data is continuously inputted for controlling the tone generator to mute the particular part of the automatic performance while allowing the sounding of the same particular part of the manual performance. The microprocessor processes the retrieved check point data for checking when the musical composition during the progression thereof reaches each break point and for controlling the tone generator to release the muting of the particular part of the automatic performance timely at a desired break point so that a complete passage of the automatic performance can be restored for the particular part.

8 Claims, 13 Drawing Sheets

ELECTRONIC MUSICAL INSTRUMENT WITH MINUS-ONE PERFORMANCE RESPONSIVE TO KEYBOARD PLAY

BACKGROUND OF THE INVENTION

The present invention relates to an electronic musical apparatus, and particularly relates to an automatic performance apparatus of the type constructed to mute a part of automatic performance when a manual implement is operated to play the same part, and constructed to restore the muted part at an adequate break point of musical passages or phrases when the operation of the manual implement is quitted.

The conventional automatic performance apparatus is operated in response to a tempo clock to read out performance data which is provisionally recorded for carrying out an automatic performance. Generally, the automatic performance apparatus stores the automatic performance data divided into a plurality of parallel parts, and is provided with a minus-one function such that one or more parts is intentionally muted while the remaining parts are sounded during the automatic performance. The minus-one function allows a player to enjoy manual performance for the muted part while keeping the automatic performance of the remaining parts. The manual performance by the minus-one function may be continued throughout one complete music composition. However, in another case, a player may wish to add ad lib manual performance for a desired period, and may wish to fill automatic performance for the rest periods a part by part. For this purpose, a modified automatic performance apparatus is proposed in Japanese Patent Application Laid-open No. 5-173561. The disclosed apparatus is constructed to temporarily mute a selected part during the automatic performance when a manual implement such as a keyboard is played to substitute the selected part by corresponding manual performance, and is constructed to restore the automatic performance of the selected part after the play of the keyboard is discontinued. However, in such a temporary minus-one play, the muting and the restoring are controlled a measure by measure. The selected part is muted for several measures including a leading measure where the keyboard is initially touched. The automatic performance of the muted part is restored from a subsequent measure immediately after the manual play of the keyboard is stopped. Therefore, the automatic performance may be incidentally or suddenly restarted from a musically inadequate point rather than musically adequate points.

SUMMARY OF THE INVENTION

In view of the drawbacks of the prior art, an object of the invention is to provide an electronic musical apparatus constructed to restore automatic performance at a musically adequate break point of a musical composition when releasing a part muted by the minus-one function.

The inventive electronic musical apparatus is constructed to play an automatic performance and a manual performance during progression of a musical composition. The inventive apparatus comprises memory means for storing a sequence of automatic performance data representative of the musical composition which is composed of a plurality of parts and which is divided into a series of passages by musically rational manner, and for storing a sequence of check point data indicative of break points of the passages, implement means manually operable for inputting a sequence of manual performance data assigned to a particular part of the musical composition, sound means receptive of the inputted manual performance data for sounding the manual performance, automatic means for sequentially retrieving the automatic performance data and the check point data from the memory means and for feeding the retrieved automatic performance data to the sound means so as to enable the same to sound the automatic performance, mute means operative when the manual performance data is continuously inputted for controlling the sound means to mute the particular part of the automatic performance while allowing the sounding of the same particular part of the manual performance, and release means receptive of the retrieved check point data for checking when the musical composition during the progression thereof reaches each break point and for controlling the sound means to release the muting of the particular part of the automatic performance timely at a desired break point so that a complete passage of the automatic performance can be restored for the particular part.

Preferably, the memory means comprises means for integrally storing the automatic performance data and the check point data with each other so that the automatic performance data and the check point data can be retrieved synchronously to each other. Otherwise, the memory means comprises means for storing the check point data separately from the automatic performance data so that the check point data and the automatic performance data are retrieved asynchronously to each other.

In a specific form, the release means comprises means for releasing the muting of the particular part of the automatic performance whenever the musical composition reaches each break point. In another specific form, the release means comprises means for releasing the muting of the particular part of the automatic performance when the inputting of the manual performance data is discontinued for a predetermined time length sufficient to assume quitting of the manual performance. In a further specific form, the release means comprises means for releasing the muting of the particular part of the automatic performance to restore the same from a succeeding passage when the inputting of the manual performance data is totally discontinued in a preceding passage. In a still further specific form, the release means includes means for comparing the manual performance data with the corresponding automatic performance data so as to determine the desired break point at which the automatic performance is restored. For example, the release means comprises means for releasing the muting of the particular part of the automatic performance retrospectively at a past break point when the manual performance has been poorly played in a past passage.

According to the present invention, the automatic performance can be restored at a musically adequate point according to the check point data which is stored to indicate musically rational or logical break points of the passages or phrases. Further, the automatic performance can be restored after the manual implement is definitely discontinued by measuring how long the manual implement is interrupted from the play. Moreover, the automatic performance can be retrospectively restored to allow the player to review and replay past passages when it is judged that the manual performance is played poorly by checking a correct hit rate of key touches.

DETAILED DESCRIPTION OF THE INVENTION

Figure 1:
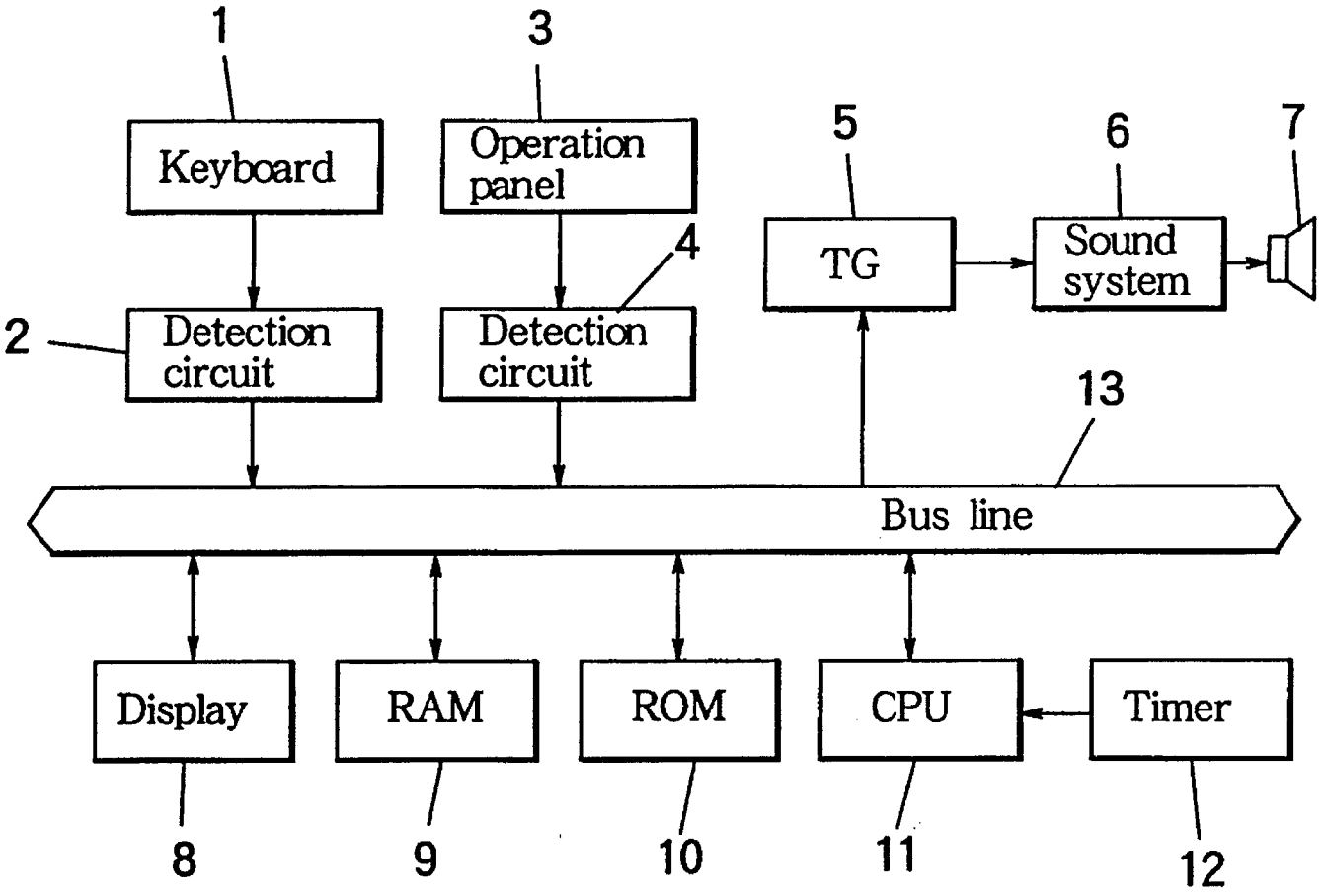
FIG. 1 is a block diagram showing an embodiment of the inventive automatic performance apparatus.

Referring to FIG. 1, the inventive automatic performance apparatus is provided with a manual implement. The apparatus performs a music composition composed of a plurality of parallel parts including a right hand part, a left hand part, a bass part, and a rhythm part. The apparatus is comprised of the manual implement in the form of a keyboard 1 and a microprocessor (CPU) 11. A detection circuit 2 is coupled to the keyboard 1 to detect a key event of the keyboard 1 and to identify which part is associated to the detected key event, thereby feeding key event and part information to the CPU 11 through a bus line 13. An operation panel 3 is equipped with various manual switches such as a timbre selection switch used in manual play, a pattern selection switch of automatic rhythms, a performance tempo setting switch, and a start/stop switch of automatic performance. Another detection circuit 4 is coupled to the operation panel 3 to detect a switch event, and to feed corresponding switch event information to the CPU 11 through the bus line 13. A tone generator (TG) 5 operates based on control by the CPU 11 to generate musical tones to sound either of the automatic performance and the manual performance. A sound system 6 amplifies the musical tones generated by the TG 5 to emit the same through a loudspeaker 7. Further, the apparatus includes a display 8 for displaying operational information when the operation panel 3 is actuated, a random access memory (RAM) 9 for storing automatic performance data, timbre data set by an user and other data, a read-only memory (ROM) 10 for storing preset timbre data and programs executed by the CPU 11 which conducts controlling of the automatic performance and the manual performance and which carries out processing of the musical tone generation by feeding the performance data to the TG 5 through the bus line 13, and a timer 12 for producing a clock signal effective to interrupt the CPU 11 according to a tempo which is set to time the automatic performance.

Figure 2A:
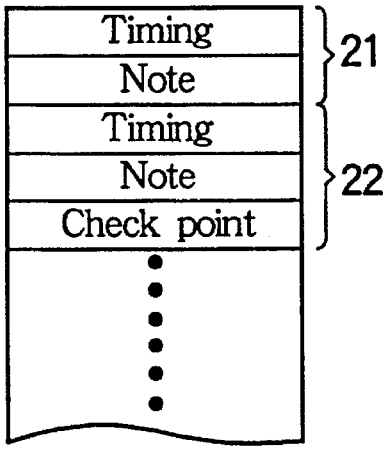
FIGS. 2A and 2B are a diagram showing automatic performance data formats.
Figure 2B:
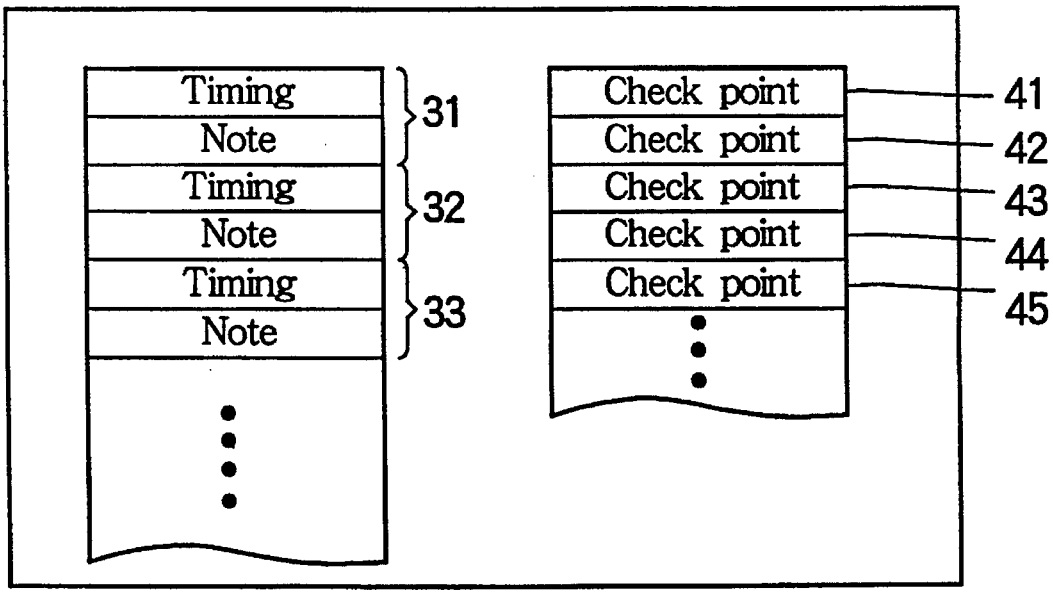

Referring to FIGS. 2A and 2B, the inventive apparatus stores, in the RAM 9, the performance data in either of two data formats. The first format shown in FIG. 2A is constructed of a sequence of data units 21, 22, . . . . Each unit is composed of a timing data and a note data. Further, the data format contains check point data which are distributed at musically periodic points of the performance data. For example, the data unit 22 integrally contains a check point data in addition to the regular timing data and the note data. Namely, according to the first format, the check point data can be read out concurrently with the performance data in synchronous manner. Preferably, the check points are positioned at musically natural periods, typically, at each end of passages or phrases. Stated otherwise, the check points are set to divide or break one musical composition into a series of passages.

The second format of FIG. 2B is composed of a sequence of performance data units 31, 32, 33, . . . , and a separate sequence of check point data units 41, 42, 43, 44, 45, . . . . The check point data are stored in a memory area allotted independently or separately from the performance data. Every performance data unit contains a timing data and a note data alone. Namely, according to the second format, the check point data are read out separately from the performance data in asynchronous manner. The second format is advantageous in that the regular performance data such as MIDI data can be utilized as they are. However, since the check point data are stored separately from the performance data, the check point data should include timing data to secure synchronization with the performance data.

The note data represent key-on information and associated tone pitch information, and event information including those of tone duration information, timbre information, tone volume information and effect information. Further, the timing data indicate occurrence timings of note events, and are represented in terms of timer clock numbers. If a plurality of events occur at the same timing, the plurality of event information are prescribed after one timing data.

Such a format of the automatic performance data is loaded in the RAM 9. The CPU 11 sequentially reads out or retrieves the performance data from the RAM 9, and feeds the same to the TG 5 so that musical tones of the automatic performance are sounded from the loudspeaker 7. The tempo of the automatic performance is determined by the clocks at which the timer 12 calls a timer interruption routine in the CPU 11.

Further, check point process is carried out subsequently to the reading process of the performance data by the timer interruption routine, according to an algorithm selected from four embodiments as will be described later in detail. The check point process is executed to restore the automatic performance if the manual play is discontinued. For summary, according to the first embodiment of the check point process, a mute state of the musical tones is released to restore the automatic performance at a check point immediately after a last occurrence of manual key events without exception. According to the second embodiment of the check point process, the mute state of the musical tones is released to restore the automatic performance at a check point which is detected when a predetermined time length lapses after the last key event occurrence of the manual play. According to the third embodiment of the check point process, when a key event does not occur between preceding and succeeding check points, the muting of the automatic musical tones is released to restore the automatic performance at the succeeding check point. According to the fourth embodiment which is a modification of the third embodiment, check is made as to if keys are correctly manipulated by the manual play such that the automatic performance is retrospectively restored at a past check point which is determined according to a correct hit rate of the key touch check.

Figure 3:
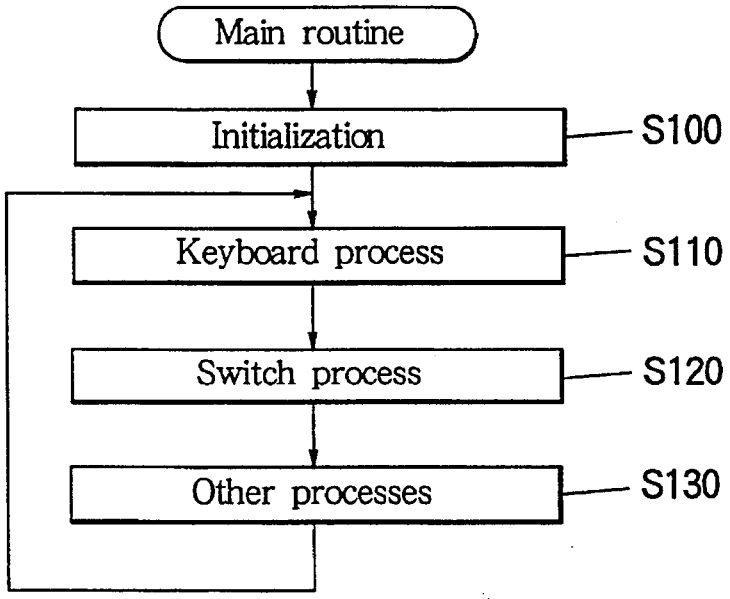
FIG. 3 is a flow chart showing a main routine executed by the inventive automatic performance apparatus.

FIG. 3 shows a main routine of the operation in the automatic performance apparatus shown in FIG. 1. In the flow chart of FIG. 3, after a power supply is turned on, a step S100 is undertaken to carry out an initialization process such as to clear various registers and to reset a RUN flag to "0". Then, the main routine proceeds to repeatedly execute a cycle of keyboard process at a step S110, switch process at a step S120 and other processes at a step S130. The keyboard process includes key-on process and key-off process. The switch process includes on/off process of the automatic performance switch. The other processes include display process.

Figure 5:
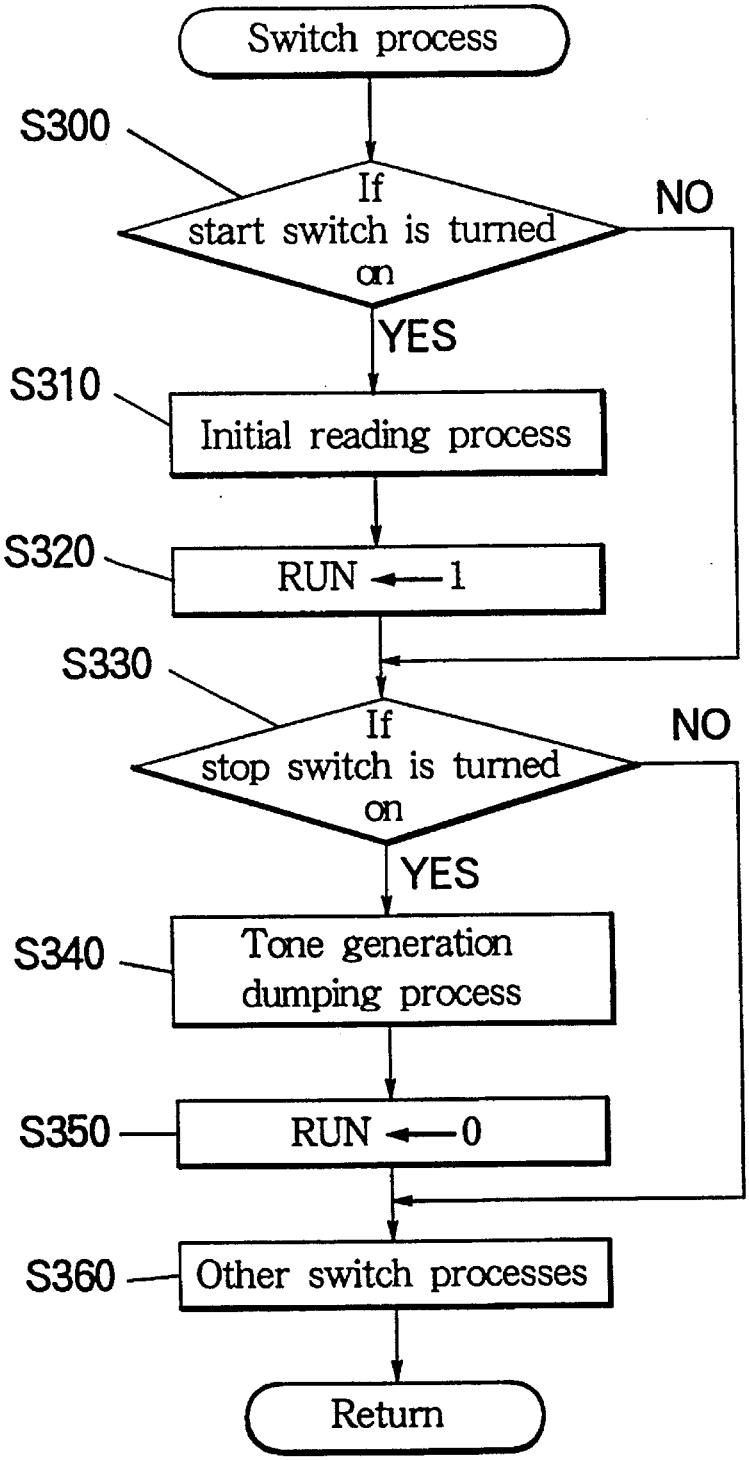
FIG. 5 is a flow chart showing a switch process involved in the main routine.

Referring to FIG. 5 which is a flow chart of the switch process, check is made at a step S300 as to if a start switch of the automatic performance is turned on. If it is judged that the start switch is turned on, initial reading process is carried out at a step S310. This initial reading process includes settings of timbre and tempo, and reading of a first timing data of the performance data. Then, the RUN flag is set with "1" at a step S320 to establish the automatic performance mode. Then, check is made at a step S330 as to if a stop switch of the automatic performance is turned on.

If it is judged by the step S330 that the stop switch is turned on, a step S340 is undertaken to execute tone generation dumping process of the automatic performance such as silencing process of musical tones currently being generated. Then, the RUN flag is set to "0" at a step S350. Further, the routine advances to a step S360 to carry out processes of other switches such as a timbre setting switch and a tone volume setting switch. If the start switch is again turned on during the automatic performance (RUN=1), that switch operation is simply ignored. In similar manner, if the stop switch is again turned on during other than the automatic performance (RUN=0), that switch operation is simply ignored. Further, a single start/stop switch may be used in place of the pair of start and stop switches to alternately change between the start and stop states whenever the single switch is actuated.

Figure 4:
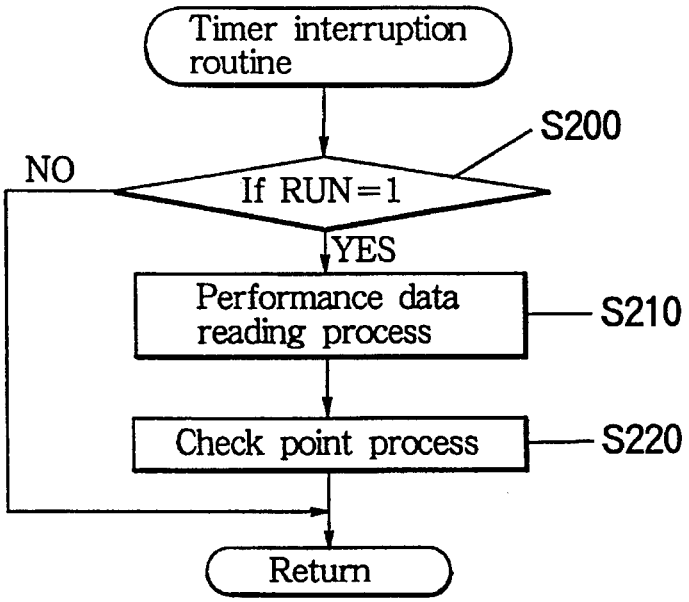
FIG. 4 is a flow chart showing a timer interruption routine executed by the inventive automatic performance apparatus.

FIG. 4 shows a flow chart of the timer interruption routine called by the timer 12. The interruption routine is executed according to the tempo clock at a certain time interval. For example, the interruption routine is executed 96 times within a period of one quarter note. When the timer 12 commands the interruption routine, check is made at a step S200 as to if the RUN flag indicates "1". If judged "1", a subsequent step S210 is undertaken to carry out the reading process of the automatic performance data. Further, the check point process is carried out at a step S220. Then, the interruption routine returns to the main routine as in the case where the step S200 judges that the RUN flag does not indicate "1".

Figure 6:
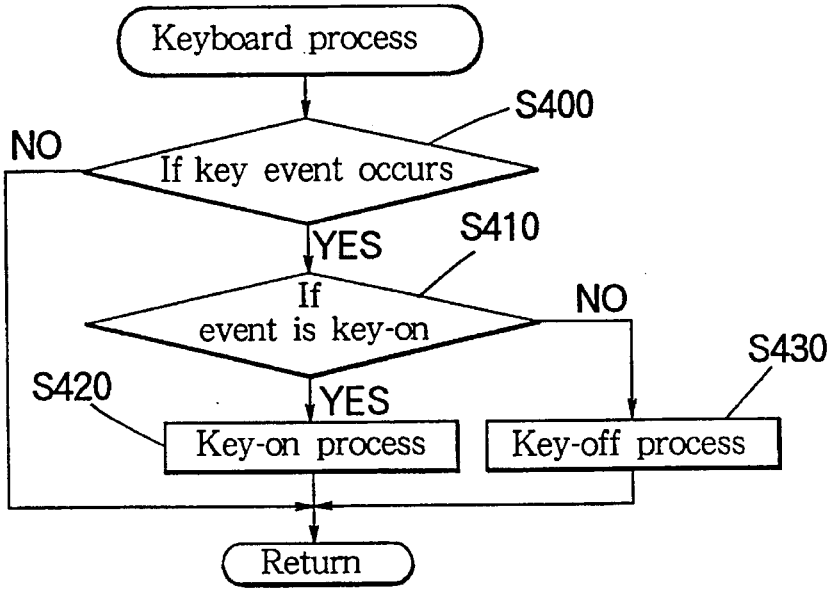
FIG. 6 is a flow chart showing a keyboard process involved in the main routine.

FIG. 6 shows a flow chart of the keyboard process involved in the main routine. First, check is made at a step S400 as to if a key event occurs in the keyboard 1. If it is judged that the key event occurs, subsequent check is made at a step S410 as to if the key event is key-on. If key-on event, key-on process is executed at a step S420, thereby returning. On the other hand, if the step S410 judges that the event is not key-on, another step S430 is undertaken to execute key-off process, thereby returning as in the case where the step S400 judges that there is no event.

Figure 8:
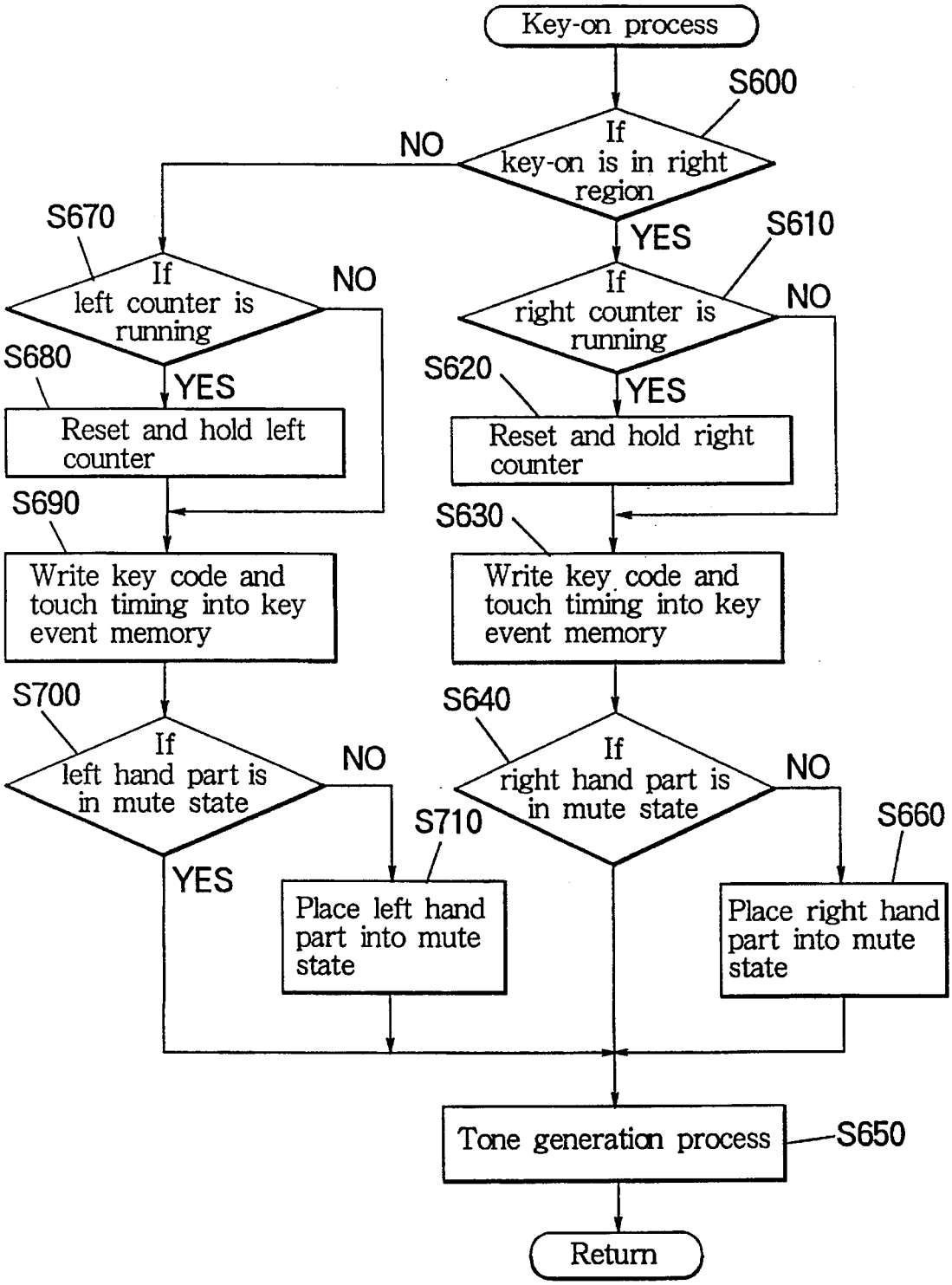
FIG. 8 is a flow chart showing a key-on process involved in the keyboard process.

FIG. 8 shows a flow chart of the key-on process executed by the step S420. First, check is made at a step S600 as to if the key-on event belongs to a right region of the keyboard 1. If Yes, next check is made at a step S610 as to if a right counter is placed in a counting state. The right counter carries out time counting when all of the keys belonging to the right region are kept in off state. The counted value is utilized to determine if the muted automatic performance should be restored upon detection of a check point which comes after a predetermined time length or pause. Therefore, if the step S610 judges that the right counter is running to continue the time counting, a subsequent step S620 is undertaken to stop and reset the right counter in response to key-on to thereby hold an initial value. Then, a step S630 is undertaken to write a touch key code and a touch timing data of the turned-on key into a key event memory, as in the case where the step S610 judges that the right counter is not running. The key event memory is referred to when the automatic performance is to be restored in case that there is no key event in a passage between successive check points. Further, the key event memory is referred to when evaluating if the manual performance by the key touches is correctly played. The touch timing data written into the key event memory is measured from a preceding check point in case of a first key-on event. Otherwise, the touch timing data is measured from a preceding key-on event in case of second and subsequent key-on events.

Thereafter, check is made at a step S640 as to if the right hand part of the automatic performance assigned to the right side region of the keyboard is placed in the mute state. If Yes, tone generation process is carried out at a step S650 in response to the turned-on key, thereby returning. On the other hand, if the step S640 judges that the right hand part is not in the mute state, a step S660 is undertaken to change the right hand part into the mute state, thereby advancing to the step S650. By such an operation, the right hand part of the automatic performance is muted in response to the key touches.

On the other hand, if the step S600 judges that the turned-on key does not belong to the right side region, another check is made at a step S670 as to if a left counter is running. The step S670 is equivalent to the step S610 of the right counter. If the step S670 judges that the left counter stays in the counting state, a step S680 is undertaken to stop and reset the left counter to thereby hold the initial value. Subsequently, a step S690 is undertaken to write the manual performance data, i.e., the touch key code and touch timing data of the turned-on key into the key event memory. The step S690 is equivalent to the step S630 of the right hand part. Then, check is made at a step S700 as to if the left hand part is placed in the mute state. If Yes, the tone generation process is conducted by the step S650 according to the turned-on or actuated key to sound the manual performance, thereby returning. On the other hand, if the step S700 judges that the left hand part is not muted, a subsequent step S710 is undertaken to mute the left hand part, thereby advancing to the step S650.

Figure 7:
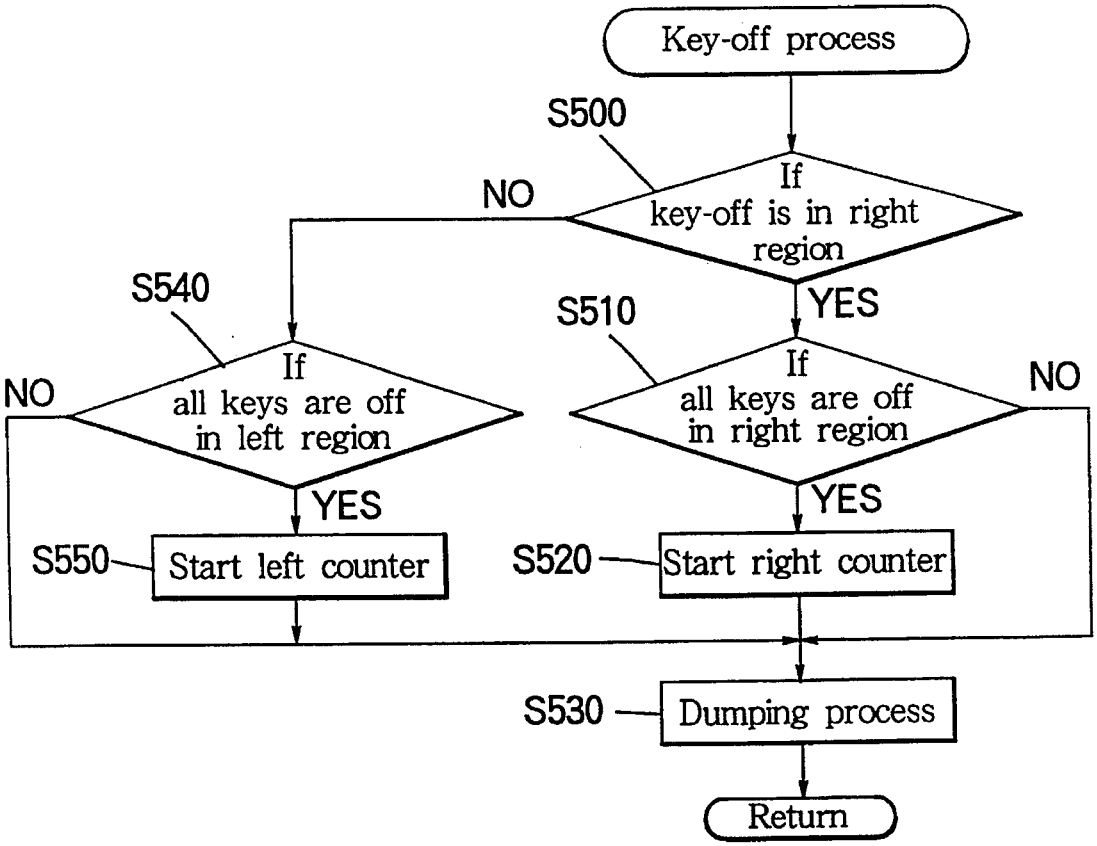
FIG. 7 is a flow chart showing a key-off process involved in the keyboard process.

FIG. 7 shows a flow chart of the key-off process executed at the step S430 of the keyboard process. First check is made at a step S500 as if the turned-off key belongs to the right region. If Yes, subsequent check is made at a step S510 as to if all of the keys stay in the turned-off state throughout the right side region. If it is judged that all the keys of the right region are kept off, a step S520 is undertaken to start the right counter to count a pause time. Further, a step S530 is undertaken to execute dumping process of the turned-off key.

On the other hand, if the step S500 judges that the turned-off key does not belong to the right region, subsequent check is made at a step S540 as to if all of the keys of the left side region are held in the off state or rest state. If Yes, the left counter starts time counting at a step S550, thereafter advancing to the dumping process of the step S530, as in the case where the step S540 judges that all of the keys are not in the rest state.

Figure 9:
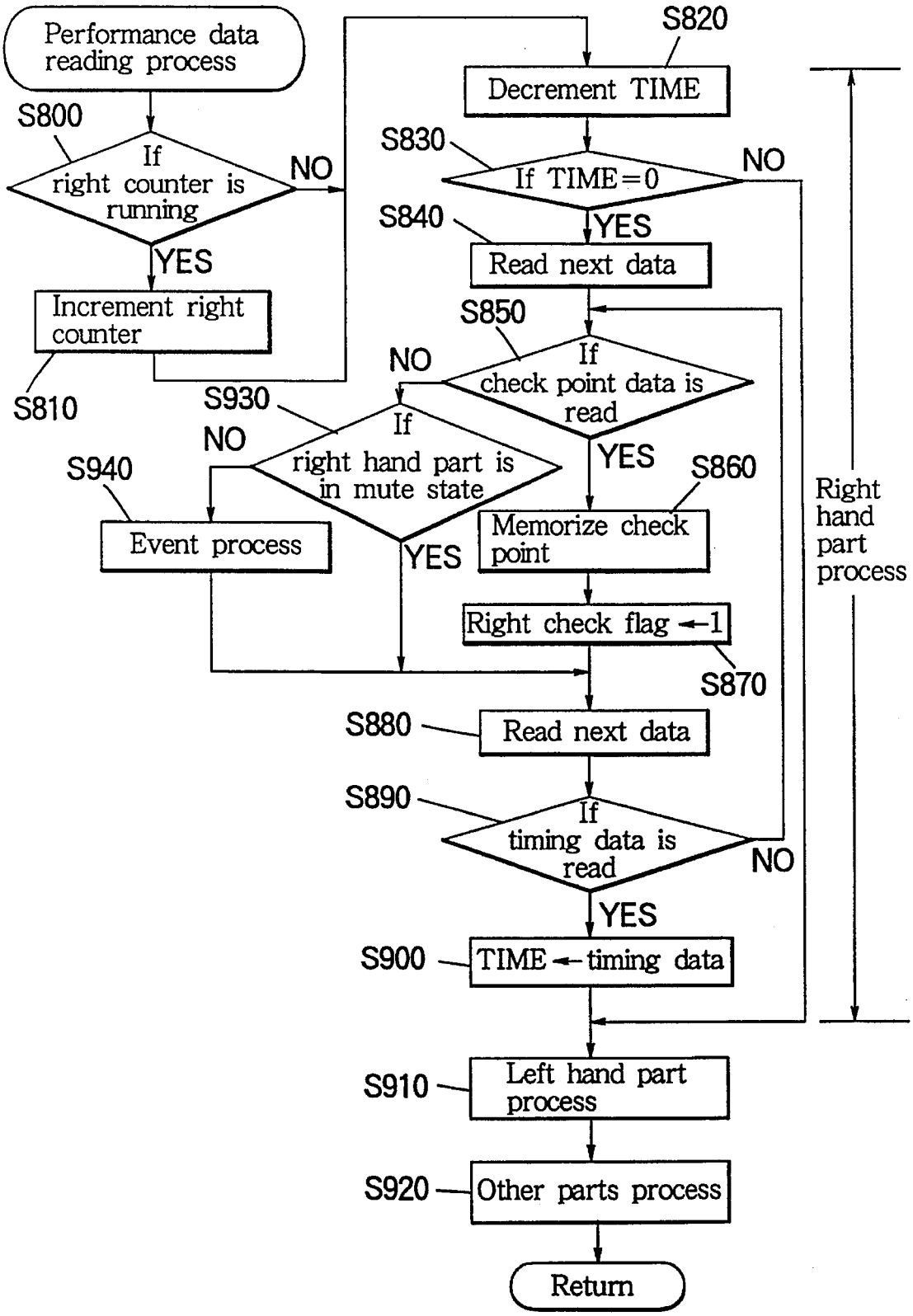
FIG. 9 is a flow chart showing a first example of a performance data reading process involved in the timer interruption routine.

FIG. 9 is a flow chart showing a first example of the performance data reading process, which deals with the first performance data format shown in FIG. 2A. First check is made at a step S800 as to if the right counter is running. If Yes, the right counter is incremented by "1" at a step S810. Then, a register TIME is decremented by "1" at a step S820. The register TIME initially stores the first timing data of the right hand part, which is retrieved by the initial reading process of the step S310 executed in the switch process routine of FIG. 5.

Then, check is made at a step S830 as to if TIME=0. If Yes, it is judged that a tone generation timing is reached so that a next sequence data is read out at a step S840. Then, check is made at a step S850 as to if the read-out data is a check point data. In this case, a next note event data must be read out after the first timing data so that the check result of the step S850 is negative. Consequently, the routine proceeds to a step S930 where check is made as to if the right hand part is placed in the mute state, i.e., as to if the right hand part is performed by the manual play. If not the mute state, namely, if the automatic performance mode, event process is carried out at a step S940 such as key-on/key-off process of the automatic performance correspondingly to the event data. Then, the routine proceeds to a step S880 where a next sequence data is read out, as in the case where the check result of the step S930 indicates that the right hand part is in the mute state.

Then, check is made at a step S890 as to if the read data is a timing data. If Yes, the timing data is set into the register TIME at a step S900. If the check result of the step S890 does not indicate the timing data, the routine returns to the step S850 where the check is made as to if the read data is a check point data. If Yes, the check point is memorized at a step S860. Further, a right check flag is set to "1" at a step S870. The memorization of the check point is utilized when the automatic performance is retrospectively returned to the memorized check point in case that the manual play is performed poorly and replete with miss key touches, as will be described later in detail. Therefore, if the memory address data, timbre data and tone volume data are changed concurrently with the check point data, these data are also memorized. Then, the routine proceeds to the step S880 where a next data is read out. Further, check is made at the step S890 as to if the read data is a timing data. By such a manner, the cycle of the steps S850–S890 is repeatedly carried out until the timing data is read out.

The routine of the steps S800–S900 is executed for the right hand part. When this right hand part process is ended, next left hand part process is carried out at a step S910 in manner similar to the right hand part process. Then, processes of the remaining parts are executed at a step S920. The performance data of the remaining parts do not contain the check point data, hence the check point process is not involved in the process of the remaining parts. Thereafter, the routine returns. Though not shown in the flow chart, the automatic performance is stopped when the performance data reaches an end point.

Figure 10:
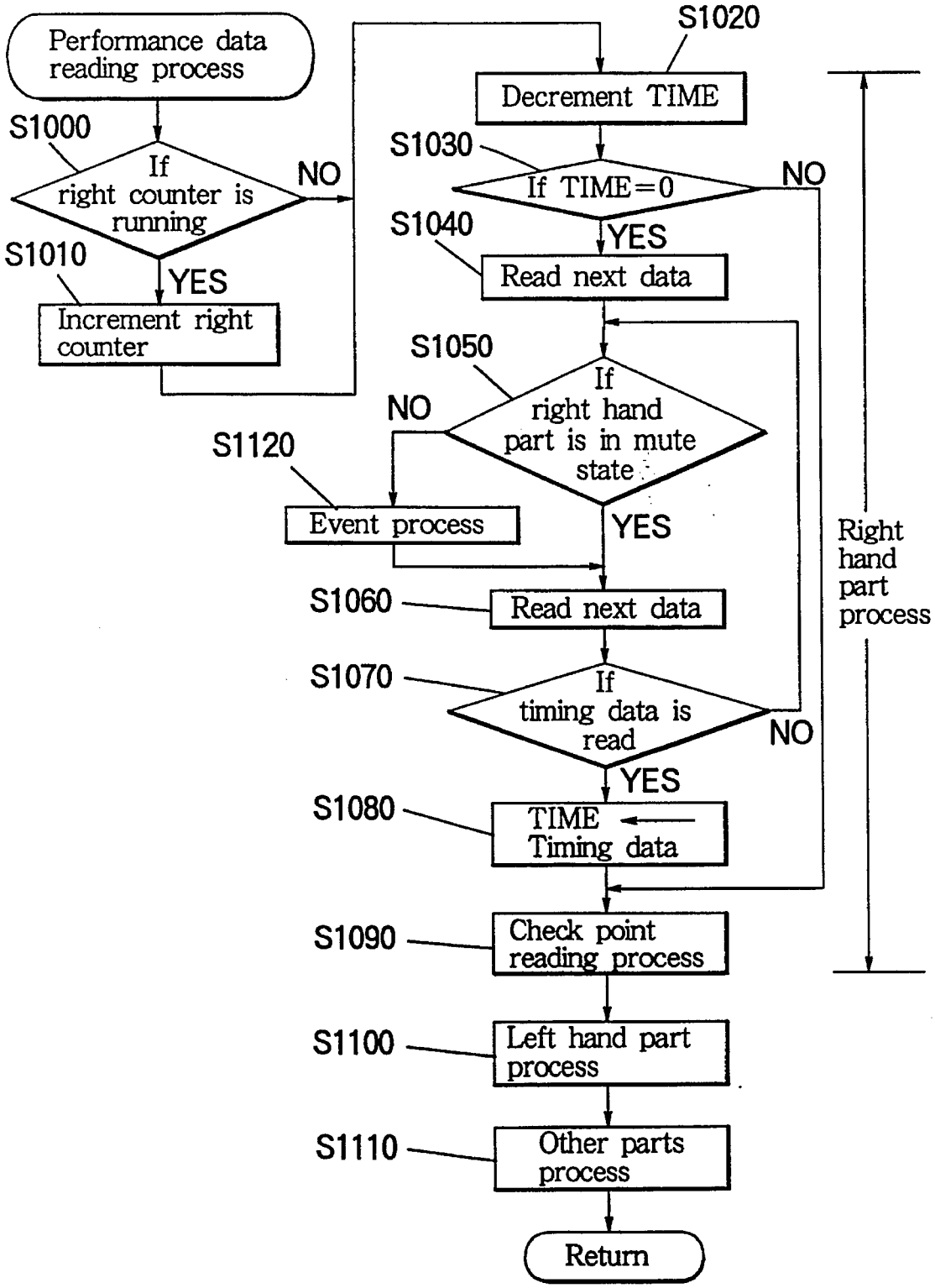
FIG. 10 is a flow chart showing a second example of the performance data reading process involved in the timer interruption routine.

FIG. 10 is a flow chart showing a second example of the performance data reading process, which deals with the automatic performance data format shown in FIG. 2B. First judgment is made at a step S1000 as to if the right counter is running. If Yes, the right counter is incremented by "1" at a step S1010. Then, the register TIME is decremented at a step S1020. Further, judgment is made at a step S1030 as to if TIME=0. If Yes, it is judged that the tone generating timing is reached so that a next sequence data is retrieved at a step S1040. Then, judgment is made at a step S1050 as to if the right hand part is placed in the mute state, i.e., placed in the manual play state. If not the mute state, key-on/key-off process (event process) of the automatic performance is carried out at a step S1120 according to the event data. Then, a next sequence data is read out at a step S1060. Next, judgment is made at a step S1070 as to if the read-out data is a timing data. If Yes, the timing data is set into TIME at a step S1080. If the step S1070 judges that the read-out data is not a timing data, the routine returns to the step S1050 where the judgment is made as to if the right hand part is placed in the mute state, i.e., in the manual performance mode. If Yes, the routine directly proceeds to the step S1060 where a next sequence data is retrieved. By such a manner, the cycle of the steps S1050–S1070 is repeatedly executed until the timing data is read out.

Thereafter, check point reading process is executed at a step S1090 subsequently to the step S1080. The routine of the steps S1000–S1090 is carried out for the right hand part. After the step S1090, left hand part process is carried out at a step S1100 in manner similar to the right hand part process. Lastly, process of the remaining parts are conducted at a step S1110 in similar manner except for the check point process since the remaining parts are not provided with the check point data. Thereafter, the routine returns. Though not shown in the flow chart, the automatic performance is stopped when the sequence of the performance data reaches an end point.

Figure 11:
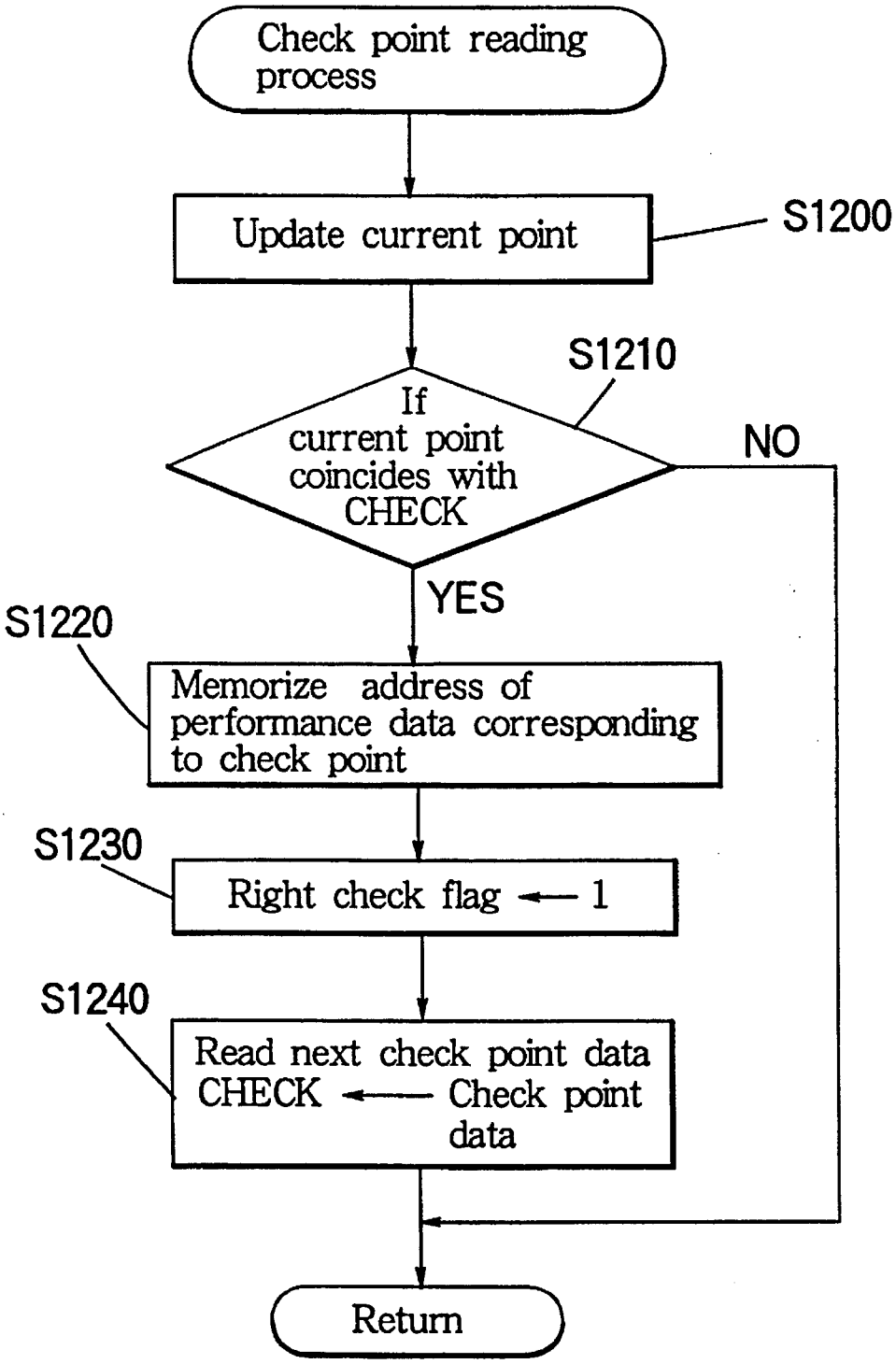
FIG. 11 is a flow chart showing a check point reading process involved in the second example of the performance data reading process.

FIG. 11 is a flow chart showing the check point reading process executed at the step S1090 of the performance data reading process routine. In this case, the check point data is retrieved from a memory area separate from the performance data according to the data format of FIG. 2B. First, a current point corresponding to a reading address of the performance data is updated at a step S1200 whenever the check point reading process is called. Next, judgment is made at a step S1210 as to if the check point data set in a register CHECK coincides with the current point. If Yes, an address of the performance data corresponding to the check point is memorized at a step S1220. The register CHECK is initially set with the first check point data which is retrieved at the initial reading process of the switch process routine. The memorized address of the performance data corresponding to the check point is utilized to retrospectively return the automatic performance to the past check point when the manual play is replete with incorrect key touches. Then, the right check flag is set with "1". Further, a next check point data is read out at a step S1240. The read-out check point data is newly set into the register CHECK, thereby returning.

Figure 12:
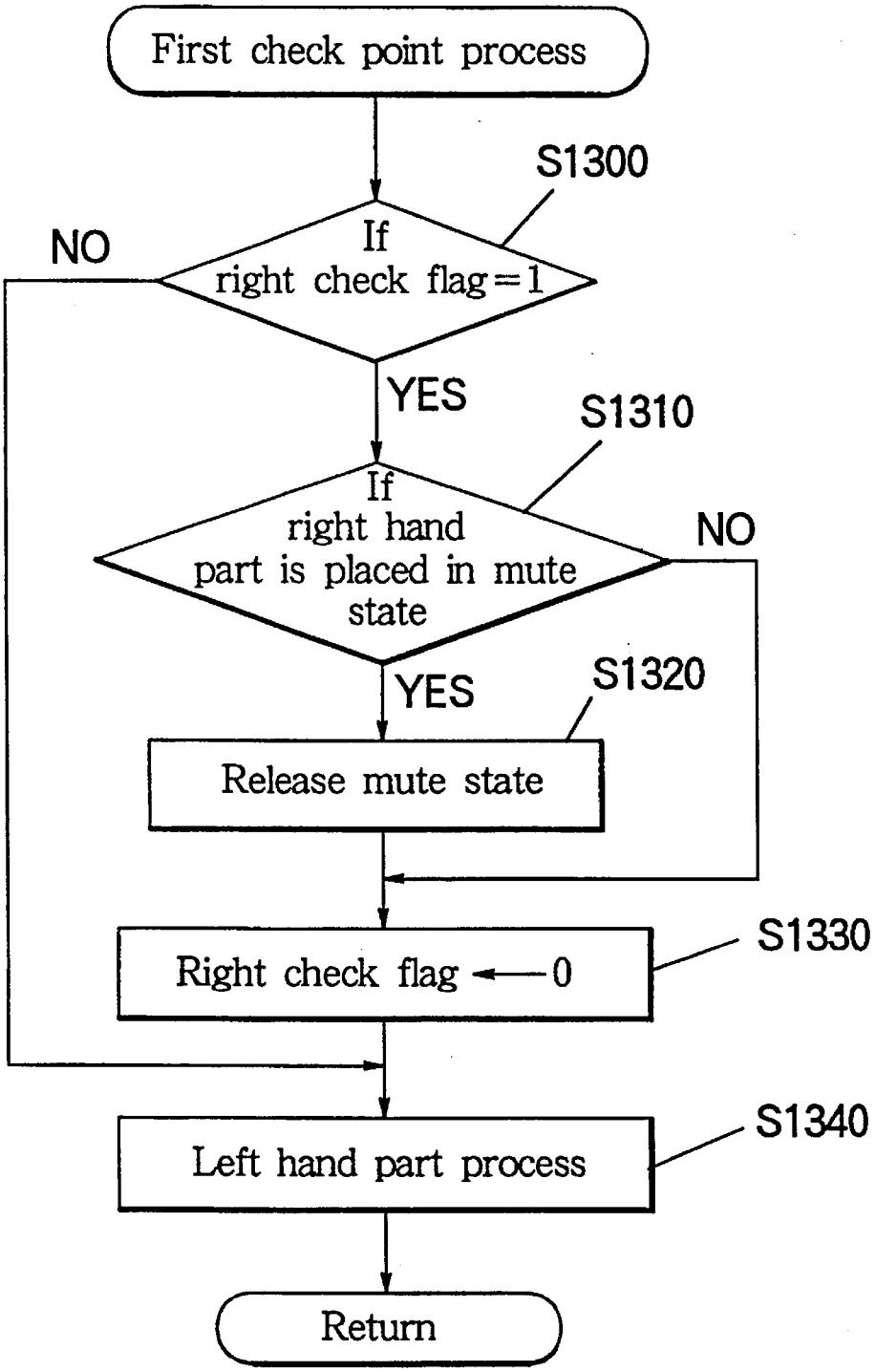
FIG. 12 is a flow chart showing a first embodiment of a check point process involved in the timer interruption routine.

FIG. 12 is a flow chart showing the first embodiment of the check point process executed at the step S220 of the timer interruption routine. In the first embodiment, the automatic performance is restored unconditionally whenever the musical composition reaches each check point. Stated otherwise, the mute state of the automatic performance is released whenever the check point comes. However, the mute state may be instantly recovered when the manual play is continued across the check point. First check is made at a step S1300 as to if the right check flag indicates "1". If Yes, it is judged that the check point reaches. Thus, subsequent check is made at a step S1310 as to if the right hand part is placed in the mute state. If the step S1310 judges that the right hand part is held in the mute state under the manual play, the mute state is released or lifted at a step S1320 to restore the automatic performance of the right hand part. Subsequently, the right check flag is reset to "0" at a step S1330, thereby finishing the process of the right hand part. Then, the left hand part is treated at a step S1340 in similar manner, thereby returning. On the other hand, if the step S1310 judges that the right hand part is not placed in the mute state, the routine directly proceeds to the step S1330 to simply reset the right check flag "0" since the automatic performance continues. Further, if the step S1300 judges that the right check flag does not indicate "1", the check point is not yet reached so that the routine proceeds to the left hand part process of the step S1340.

Figure 13:
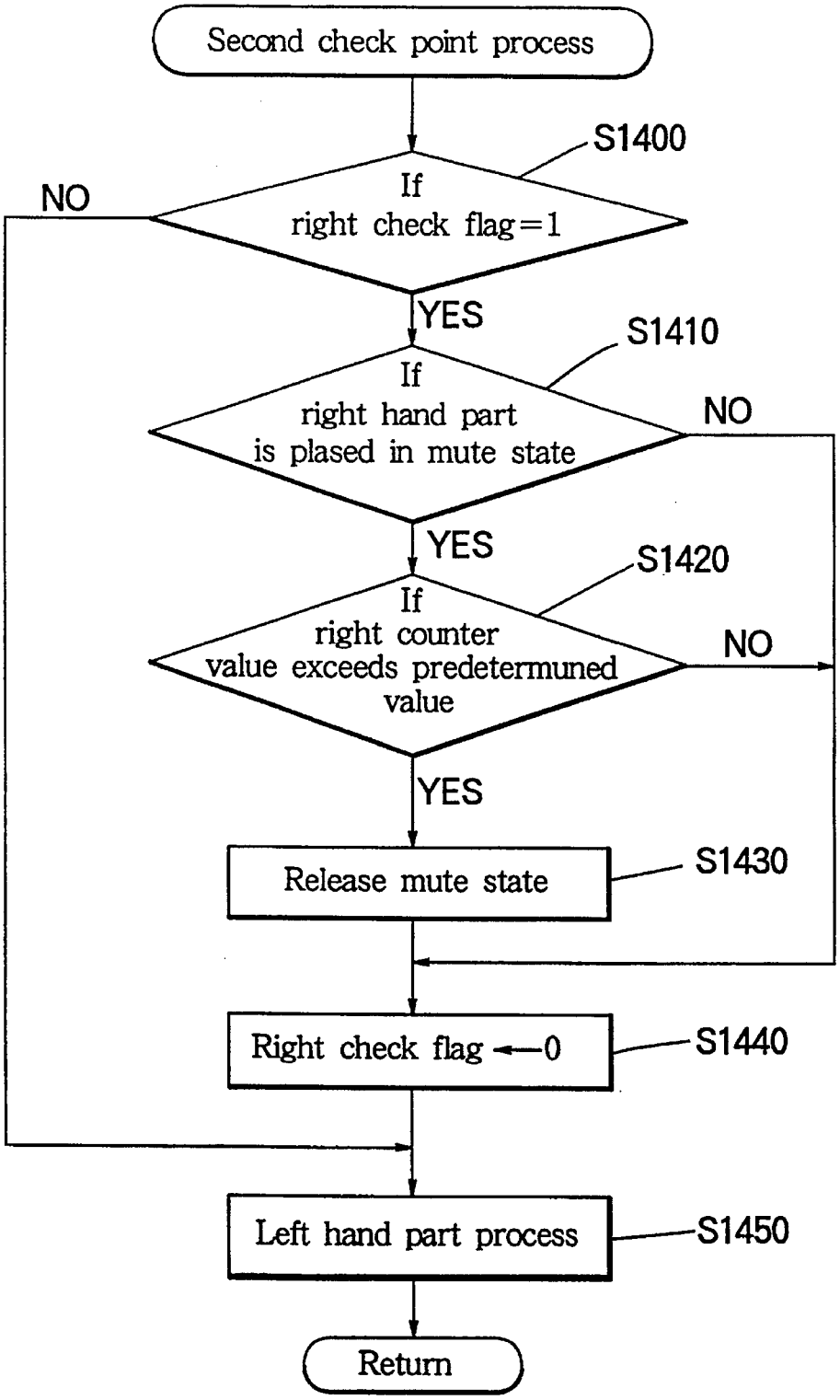
FIG. 13 is a flow chart showing a second embodiment of the check point process.

FIG. 13 is a flow chart showing the second embodiment of the check point process where the automatic performance mode is restored when the check point reaches provided that keys are not operated for a predetermined time length around the check point. First judgment is made at a step S1400 as to if the right check flag indicates "1". If Yes, it is judged that the check point is reached so that subsequent judgment, is made at a step S1410 as to if the right hand part stays in the mute state. If Yes, further judgment is made at a step S1420 as to if the counted value of the right counter exceeds a predetermined value. If it is judged that the counted value exceeds the predetermined value, none of the keys in the right side region is actuated for the predetermined time length so that the mute state is released at a step S1430 to restore the automatic performance.

Subsequently, the right check flag is reset to "0" at a step S1440 to finish the process of the right hand part. Then, the left hand part is treated at a step S1450 in similar manner, thereby returning. If the step S1410 judges that the right hand part is not placed in the mute state, the automatic performance is maintained so that the routine directly proceeds to the step S1440 where the right check flag is simply reset. Similarly, if the step S1420 judges that the value of the right counter does not exceed the predetermined value, the right check flag is set to "0" at the step S1440 because the key is actuated within the predetermined time length when passing the check point. Further, if the step S1400 judges that the right check flag does not indicate "1", the routine proceeds to the left hand part process of the step S1450 since the check point is not yet reached in the right hand part.

For example, the predetermined time length is set in the order of one measure. However, the predetermined time length is not limited to one measure, but may be set shorter or longer than one measure. Generally, the predetermined time length is suitably set to a sufficient pause such that the player definitely quits the manual performance.

Figure 14:
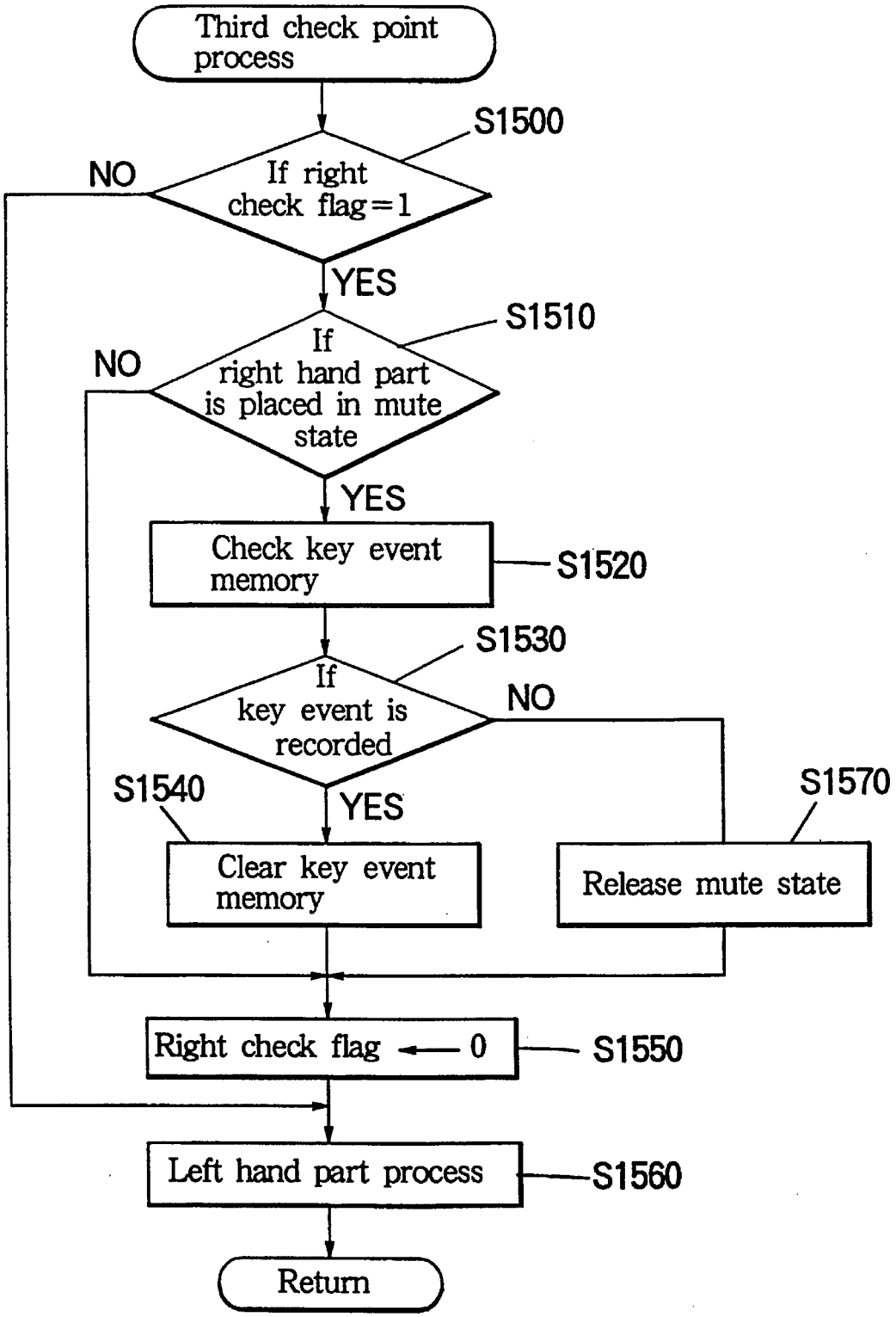
FIG. 14 is a flow chart showing a third embodiment of the check point process.

FIG. 14 is a flow chart showing the third embodiment of the check point process where the automatic performance is restored provided that no key event occur at all between successive check points or break points. First judgment is made at a step S1500 as to if the right check flag is set to "1". If Yes, it is judged that the check point is reached so that second judgment is made at a step S1510 as to if the right hand part is placed in the mute state. If Yes, it is judged that the right hand part is under the manual performance mode so that the key event memory is checked and examined at a step S1520.

Subsequent judgment is made at a step S1530 as to if key event information is written or recorded in the key event memory according to the examination results. If it is judged that no key event information is memorized in the memory, the mute state is released at a step S1570 to restore the automatic performance since no keys are actuated throughout a preceding passage between the previous check point and the outstanding check point. On the other hand, if it is judged at the step S1530 that the key event information is recorded, the routine branches to a step S1540 to simply clear the key event memory without restoring the automatic performance because the key is actuated in the preceding passage. Then, the right check flag is reset to "0" at a step S1550 to finish the process of the right hand part. Lastly, the left hand part is treated at a step S1560 in similar manner, thereby returning. If the step S1510 judges that the right hand part is not in the mute state, the automatic performance mode is already established so that the right check flag is simply reset at the step S1550. Further, if the step S1500 judges that the right check flag does not indicate "1", the routine jumps to the step S1560 to execute the left hand part process since the check point is not yet reached in the right hand part.

Figure 15:
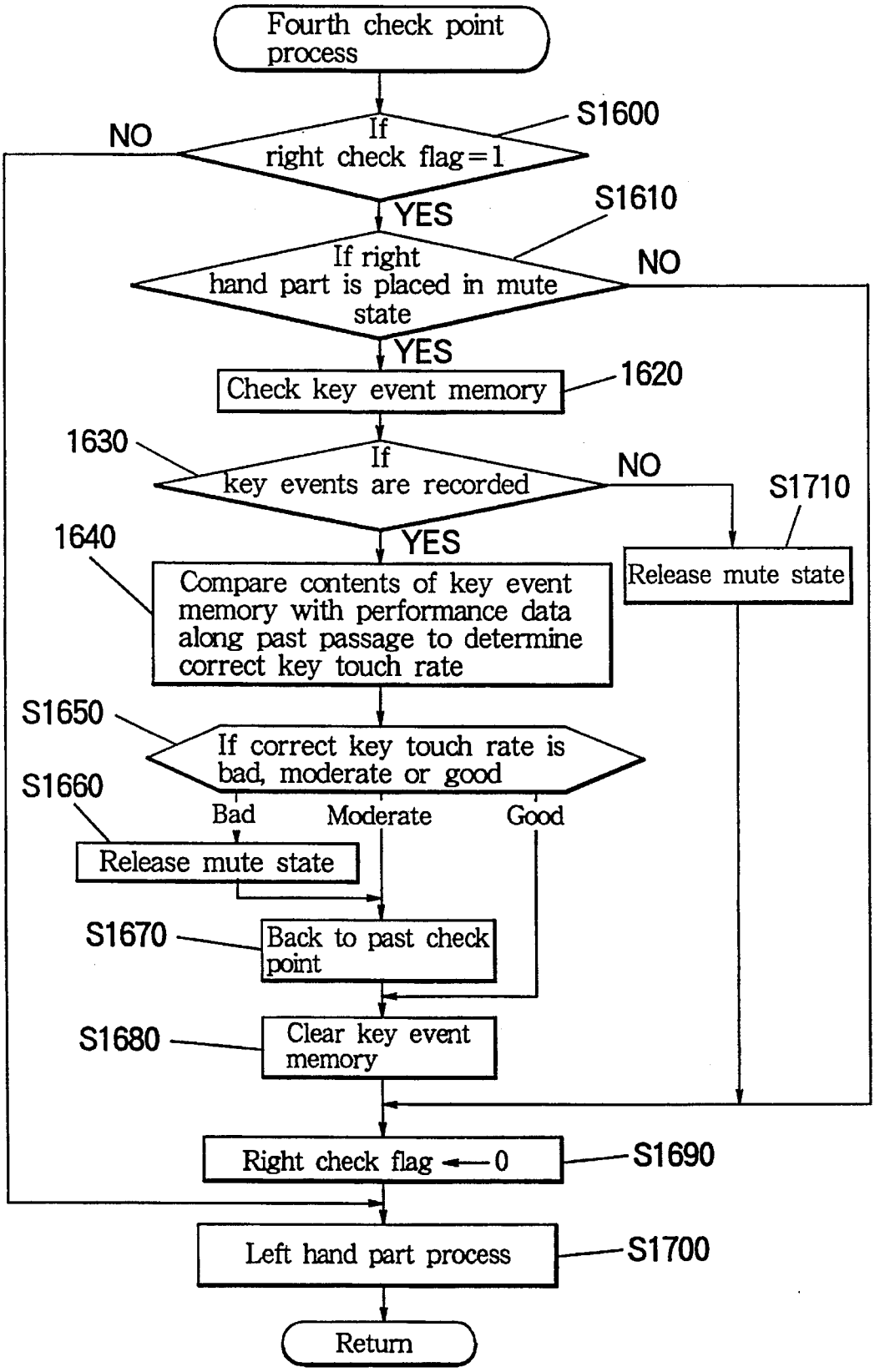
FIG. 15 is a flow chart showing a fourth embodiment of the check point process.

FIG. 15 is a flow chart showing the fourth embodiment of the check point process which is basically identical to the third embodiment of the check point process and which is modified to retrospectively restore the automatic performance at a previous check point according to a correct hit rate of the key touches during the manual play, for training purpose. As shown in the flow chart, steps S1600 through S1630 and step S1710 are sequentially undertaken in manner identical to the steps S1500 through S1530 and step S1570 of the third embodiment shown in FIG. 14.

If it is judged at the step S1630 that key events are recorded, comparison is made at a step S1640 between the manual performance data recorded in the key event memory and the corresponding automatic performance data read out in the past passage between the previous and the current check points so as to evaluate the correct key touch rate of the manual play according to a known technology. Then, the comparison results are evaluated as to how the keys are correctly manipulated. If the step S1650 judges that there are few correct key events, the mute state is released at a step S1660 to restore the automatic performance. At this moment, a reading address of the performance data is retrospectively changed by a step S1670 to the past check point which is memorized at either of the steps S860 and S1220. Therefore, the automatic performance is reproduced retrospectively according to the performance data after the past check point. Consequently, the player can review his/her manual performance by listening to the reproduced automatic performance.

If the step S1650 judges that the correct key touch rate is at a moderate degree, the routine directly proceeds to the step S1670 so that the reading address of the automatic performance of the remaining parts is backed to the past check point, while the mute state of the right hand part is maintained. Thus, the player can again practice the right hand part in the past passage between the previous and the last check point.

If the step S1650 judges that the manual play is performed almost perfectly at a good correct hit rate, the routine jumps to a step S1680 where the key event memory is cleared. Subsequently, the right check flag is reset to "0" at a step S1690, thereby preparing for the next check point process. Namely, the manual play can be continued in case of the high or good hit rate. After finishing the right hand part process as described above, the routine advances to a step S1700 to carry out the left hand part process in similar manner, thereby returning.

The fourth embodiment of the check point process is designed to realize repeated practice in the past or preceding passage based on the third embodiment. However, the fourth embodiment can be introduced into either of the first embodiment where the manual play can be practiced until each check point, or the second embodiment where the manual play can be practiced unless the predetermined time length lapses.

The inventive automatic performance apparatus can be extensively applied to automatic rhythm performance and automatic accompaniment. For example, when a pad of a percussion instrument is struck, a rhythm part having a timbre assigned to the struck pad is muted in the automatic rhythm performance. Then, the muted part is restored according to successively retrieved check points. Further, the invention can be applied to a combination of an automatic performance unit and a separate manual performance unit such as a keyboard instrument. The manual performance unit feeds a sequence of note data to the automatic performance unit. The manual performance unit may directly produce the note data, or may indirectly produce the note data by extracting a pitch from musical tones of an acoustic instrument. On the other hand, the automatic performance unit effects the muting control in response to the externally fed note data. Moreover, the muted part may be discriminated by an assigned timbre, rather than a split key region. In addition, key touch instruction may be provided in the manual performance according to the corresponding automatic performance data.

As described above, according to the invention, the check point is memorized to determine each expressive passage such as phrase of a given musical composition. The automatic performance of the music composition is restored at the check point by a musically proper timing. Further, the automatic performance can be restored after the manual performance is definitely quitted or discontinued by checking a pause after the last key event at or around the check point, or by checking absence of key events in a preceding passage between preceding and succeeding check points. Moreover, the correct hit rate is examined during the manual play under the mute state of the automatic performance so as to select a returning check point of the restored automatic performance according to the examined results. For example, the automatic performance is retrospectively restored when the hit rate is poor so as to enable the player to review the manual play.

What is claimed is:

1. An electronic musical apparatus for playing an automatic performance and a manual performance during progression of a musical composition, comprising:

memory means for storing a sequence of automatic performance data representative of the musical composition which is composed of a plurality of parts and which is divided into a series of passages by musically rational manner, and for storing a sequence of check point data indicative of break points of the passages;

implement means manually operable for inputting a sequence of manual performance data assigned to a particular part of the musical composition;

sound means receptive of the inputted manual performance data for sounding the manual performance;

automatic means for sequentially retrieving the automatic performance data and the check point data from the memory means and for feeding the retrieved automatic performance data to the sound means so as to enable the same to sound the automatic performance;

mute means operative when the manual performance data is continuously inputted for controlling the sound means to mute the particular part of the automatic performance while allowing the sounding of the same particular part of the manual performance; and release means receptive of the retrieved check point data for checking when the musical composition during the progression thereof reaches each break point and for controlling the sound means to release the muting of the particular part of the automatic performance timely at a desired break point so that a complete passage of the automatic performance can be restored for the particular part.

2. An electronic musical apparatus according to claim 1; wherein the memory means comprises means for integrally storing the automatic performance data and the check point data with each other so that the automatic performance data and the check point data can be retrieved synchronously to each other.

3. An electronic musical apparatus according to claim 1; wherein the memory means comprises means for storing the check point data separately from the automatic performance data so that the check point data and the automatic performance data are retrieved asynchronously to each other.

4. An electronic musical apparatus according to claim 1; wherein the release means comprises means for releasing the muting of the particular part of the automatic performance whenever the musical composition reaches each break point.

5. An electronic musical apparatus according to claim 1; wherein the release means comprises means for releasing the muting of the particular part of the automatic performance when the inputting of the manual performance data is discontinued for a predetermined time length sufficient to assume quitting of the manual performance.

6. An electronic musical apparatus according to claim 1; wherein the release means comprises means for releasing the muting of the particular part of the automatic performance to restore the same from a succeeding passage when the inputting of the manual performance data is totally discontinued in a preceding passage.

7. An electronic musical apparatus according to claim 1; wherein the release means includes means for comparing the manual performance data with the corresponding automatic performance data so as to determine the desired break point at which the automatic performance is restored.

8. An electronic musical apparatus according to claim 1; wherein the release means comprises means for releasing the muting of the particular part of the automatic performance retrospectively at a past break point when the manual performance has been poorly played in a past passage.

* * * * *